US007149449B2

(12) United States Patent
Kietzman et al.

(10) Patent No.: US 7,149,449 B2
(45) **Date of Patent: *Dec. 12, 2006**

(54) METHOD OF DETERMINING A RELATIVE SPEED BETWEEN INDEPENDENTLY DRIVEN MEMBERS IN AN IMAGE FORMING APPARATUS

(75) Inventors: John William Kietzman, Lexington, KY (US); Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 214 days.

This patent is subject to a terminal disclaimer.

(21) Appl. No.: 10/844,784

(22) Filed: May 13, 2004

(65) Prior Publication Data

US 2005/0254847 A1 Nov. 17, 2005

(51) Int. Cl.
*G03G 15/20* (2006.01)

(52) U.S. Cl. ..... 399/68

(58) Field of Classification Search ..... 399/67–70
See application file for complete search history.

(56) References Cited

U.S. PATENT DOCUMENTS

| | | | |
|---|---|---|---|
| 4,697,920 | A | 10/1987 | Palm et al. |
| 4,739,230 | A | 4/1988 | Sonobe et al. |
| 4,897,778 | A | 1/1990 | Miyamoto et al. |
| 4,954,863 | A | 9/1990 | Harada et al. |
| 5,050,859 | A | 9/1991 | Paxon |
| 5,170,215 | A | 12/1992 | Pfeuffer |
| 5,185,627 | A | 2/1993 | Hartman |
| 5,363,023 | A | 11/1994 | Choho |
| 5,467,173 | A | 11/1995 | Sakata et al. |
| 5,493,374 | A | 2/1996 | Smith et al. |
| 5,493,378 | A | 2/1996 | Jamzadeh et al. |
| 5,508,789 | A | 4/1996 | Castelli et al. |
| 5,519,478 | A | 5/1996 | Malachowski |
| 5,574,527 | A | 11/1996 | Folkins |
| 5,600,424 | A | 2/1997 | Malachowski |
| 5,623,722 | A | 4/1997 | Hawley et al. |
| 5,819,149 | A | 10/1998 | Watanabe et al. |
| 5,983,049 | A | 11/1999 | Matsuya et al. |
| 6,016,409 | A | 1/2000 | Beard et al. |
| 6,038,423 | A | 3/2000 | Tagawa et al. |
| 6,122,075 | A | 9/2000 | Yamada et al. |
| 6,172,696 | B1 | 1/2001 | Fujikura et al. |
| 6,363,228 | B1 | 3/2002 | Ream |
| 6,389,240 | B1 | 5/2002 | Toyoharra et al. |
| 6,483,996 | B1 | 11/2002 | Phillips |

(Continued)

*Primary Examiner*—David M. Gray
*Assistant Examiner*—Laura K Roth
(74) *Attorney, Agent, or Firm*—Taylor & Aust, PC

(57) ABSTRACT

A method of determining a relative speed between two separately driven members in an image forming apparatus, includes the steps of: transporting a print medium using a print media transport assembly including a first nip, the print media transport assembly operable at a first transport speed; driving a rotatable member associated with a second nip at a second transport speed which is independent from the first transport speed; printing a first image on the print medium when the print medium is in at least one of the first nip and the second nip; printing a second image on the print medium when the print medium is in each of the first nip and the second nip, the second image overlapping the first image; detecting a moiré pattern caused by the first image and the second image; and determining a speed relationship between the first transport speed and the second transport speed, dependent upon the detected moiré pattern.

18 Claims, 6 Drawing Sheets

U.S. PATENT DOCUMENTS

| | | | |
|---|---|---|---|
| 6,542,703 | B1 | 4/2003 | Jung |
| 6,560,434 | B1 | 5/2003 | Chapman et al. |
| 6,615,005 | B1 | 9/2003 | Maruyama |
| 6,661,981 | B1 | 12/2003 | Boothe et al. |
| 6,671,470 | B1 | 12/2003 | Suzuki et al. |
| 2001/0028807 | A1 | 10/2001 | Coleman et al. |
| 2003/0143003 | A1 | 7/2003 | Stringham |
| 2003/0185609 | A1 | 10/2003 | Kikuchi et al. |
| 2004/0130613 | A1* | 7/2004 | To et al. |

* cited by examiner

Regions of a print sample

Moire print sample at 104.991mm/s fuser speed:

Moire print sample at 107.030mm/s fuser speed:

Fuser speed estimate via moire shift data

METHOD OF DETERMINING A RELATIVE SPEED BETWEEN INDEPENDENTLY DRIVEN MEMBERS IN AN IMAGE FORMING APPARATUS

BACKGROUND OF THE INVENTION

1. Field of the Invention

The present invention relates to an image forming apparatus, such as an electrophotographic (EP) printer, and, more particularly, to a method of determining a relative speed between two separately driven members in such a printer.

2. Description of the Related Art

Cost and market pressures promote the design of the smallest possible printer with the shortest possible length of paper path. Short paper paths mean that media (especially legal-length media) are involved in more than one operation at once, and may span adjacent components. For example, a piece of paper in a printer which images directly onto paper may be at more than one imaging station while it is also in the fuser at the same time.

Tandem color laser printers which image directly onto paper typically use a paper transport belt to move media past successive imaging stations before fusing the final image onto the media. Velocity variation is a problem created when fuser or machine component tolerances or thermal growth affect the speed ratio between the fuser and the paper transport system upstream from it. Rather than having a constant ratio between the fuser and the paper transport system, this speed ratio varies from machine to machine and from time to time or mode to mode within the same machine. This can cause registration errors, and can cause scrubbing or other print defects as well.

For optimal registration of the imaging planes in tandem color laser printers, the surface speeds of the photoconductors and the media (in a direct-to-paper machine) must be precisely controlled. To achieve this, it is important that no external loads disturb the motor system moving the media. In a hot-roll fuser, the fusing nip is typically a high-force nip, with pressures on the order of 20 psi or more. This high-force nip has a sufficient grip on the media that the fuser will attempt to control the speed of the media regardless of what other systems are regulating its speed. The ability of a fuser to overwhelm other media feeding devices, and the problems this causes, may also be shared by other fuser technologies, such as belt fusers or fusers with belt backup members. For certain types of belt fusers, the backup roll is the driven member, so its effective drive diameter controls the speed of the media.

In direct-to-paper machines, if media is pulled taut between an imaging nip and a fusing nip operating at a higher speed, the disturbance force transmitted via the media from the fuser to the paper transport belt causes image registration errors. To prevent these, the fuser is often under driven so that a media bubble accumulates between the transport belt and the fuser. Since the fuser runs more slowly, the media never becomes taut, so less disturbance force can be transmitted from the fuser to the transport belt. However, the pursuit of small machines means that media bubbles must be constrained to stay as small as possible. If a machine is designed for a certain maximum bubble size, large velocity variations can make the media try to form a bigger bubble. If this happens, the media will probably make contact with machine features which scrape across the image area, causing print defects. The media might also "snap through", from the desired bubble configuration into a new one which is undesirable. This snapping action may also disturb the image and create print defects.

Ideally, the fuser is just slightly under driven so that a small paper bubble develops, but does not occupy much space in the machine. However, many factors affect the relative speeds of the transport belt and the fuser, potentially creating a large range of relative velocity variation. The nominal under drive of the fuser must be set such that the worst-case velocity variation condition still results in fuser under drive or exact speed matching, but never fuser overdrive (which would create taut media).

The speed of the media on a paper transport belt is set by the motion of the transport belt and photoconductive drums which form respective nips with the belt. The speed of the media in the fuser is controlled by the motion of the driven fuser member, roll compliance, drag on the backup roll, and friction coefficients between media and the two fuser rollers. In a hot-roll fuser, the hot roll is usually gear-driven while the backup roll idles on low-friction bearings. Therefore, the surface speed of the hot roll determines the speed of the media in the fuser. In some fuser systems where the backup roll is driven, the speed of that member controls the speed of the media.

The transport speed variances of the fuser can be divided into two primary categories: 1) the effect of temperature variations on the fuser roll, and 2) manufacturing variances such as dimensional tolerances, varying physical properties of materials used in components, different preload nip pressures, etc. Effects of temperature variations of the fuser roll at different operating temperatures are addressed in a manner described in a separate patent application entitled "METHOD OF DRIVING A FUSER ROLL IN AN ELECTROPHOTOGRAPHIC PRINTER", U.S. patent application Ser. No. 10/757,301, filed Jan. 14, 2004, which is assigned to the assignee of the present invention.

Manufacturing variances have been addressed heretofore, but in much more complicated and expensive ways. Merely measuring the outside diameter of a fuser roll and its rotational speed and calculating its circumference or surface speed is not good enough because the roll deforms during rotation. This deformation means that the actual distance media travels during one roll revolution through the fuser is not the same as the circumference of the roll. One method is to place a piece of tape on a fuser roll, and then to fuse solid-coverage images using the fuser roll. The tape causes a print defect at the period of the effective roll circumference, allowing distance traveled during one roll revolution to be accurately measured. The reduction in size of the media as it loses moisture during the fusing process complicates this process, since this change must be accounted for in calculating the period of the print defect. The use of tape is also undesirable since it risks roll damage which could cause later print defects.

U.S. Pat. No. 5,819,149 describes sensing methods for directly monitoring the size of a backup roll in a belt fuser. As the backup roll changes size, its peripheral velocity will change, so the media velocity going through the fuser will also change. Monitoring roll size allows the printer to maintain a desired media speed through the fuser. However, as discussed above, roll circumference will not strictly match the media advance distance during one roll revolution, so this method introduces errors.

U.S. Pat. No. 5,170,215 describes the use of a separate media speed sensor to determine whether a fuser is pulling on continuous-form media. The additional required sensors undesirably increase the cost of the printer.

U.S. Pat. No. 5,508,789 describes a speed measurement method for determining the photoconductor drum speed needed to match speeds between an intermediate transfer belt and the photoconductor drum. The speed of the drum is varied while monitoring current to the drum drive motor, while the belt is driven and servo-actuated independently. Over a long-period speed oscillation (200 seconds), large variations in current demand caused by dry friction between the drum and belt materials when their speeds nearly match are monitored. This dry friction phenomenon provides a large physical response at the point of matching speeds.

Each of these known patented methods uses additional sensors for sensing continuously available parameters or measuring parameters while components are in direct continuous contact. This increases the complexity and cost of related printers.

What is needed in the art is a method of determining and setting a transport speed of a downstream driven member relative to a transport speed of an independent upstream driven member, without requiring additional sensors, etc.

SUMMARY OF THE INVENTION

The present invention provides a method of setting a transport speed of a downstream driven member relative to a transport speed of an upstream driven member by detecting moiré patterns on multiple printed sheets and determining a speed of the downstream driven member which most closely matches a transport speed of the upstream driven member.

The invention comprises, in one form thereof, a method of determining a relative speed between two separately driven members in an image forming apparatus, including the steps of: transporting a print medium using a print media transport assembly including a first nip, the print media transport assembly operable at a first transport speed; driving a rotatable member associated with a second nip at a second transport speed which is independent from the first transport speed; printing a first image on the print medium when the print medium is in at least one of the first nip and the second nip; printing a second image on the print medium when the print medium is in each of the first nip and the second nip, the second image overlapping the first image; detecting a moiré pattern caused by the first image and the second image; and determining a speed relationship between the first transport speed and the second transport speed, dependent upon the detected moiré pattern.

An advantage of the present invention is that the relative speed between the independently driven members can be determined without additional sensors.

Another advantage is that the transport speed of the downstream member can be set at a predetermined amount less than the upstream member so as to avoid certain print defects.

Yet another advantage is that the point at which the transport speed of the downstream driven member matches the transport speed of the upstream driven member can be established using observation or a linear data fit.

A still further advantage is that the method of determining and setting the relative transport speed of the downstream driven member can occur during manufacture or upon replacement of the downstream driven member.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
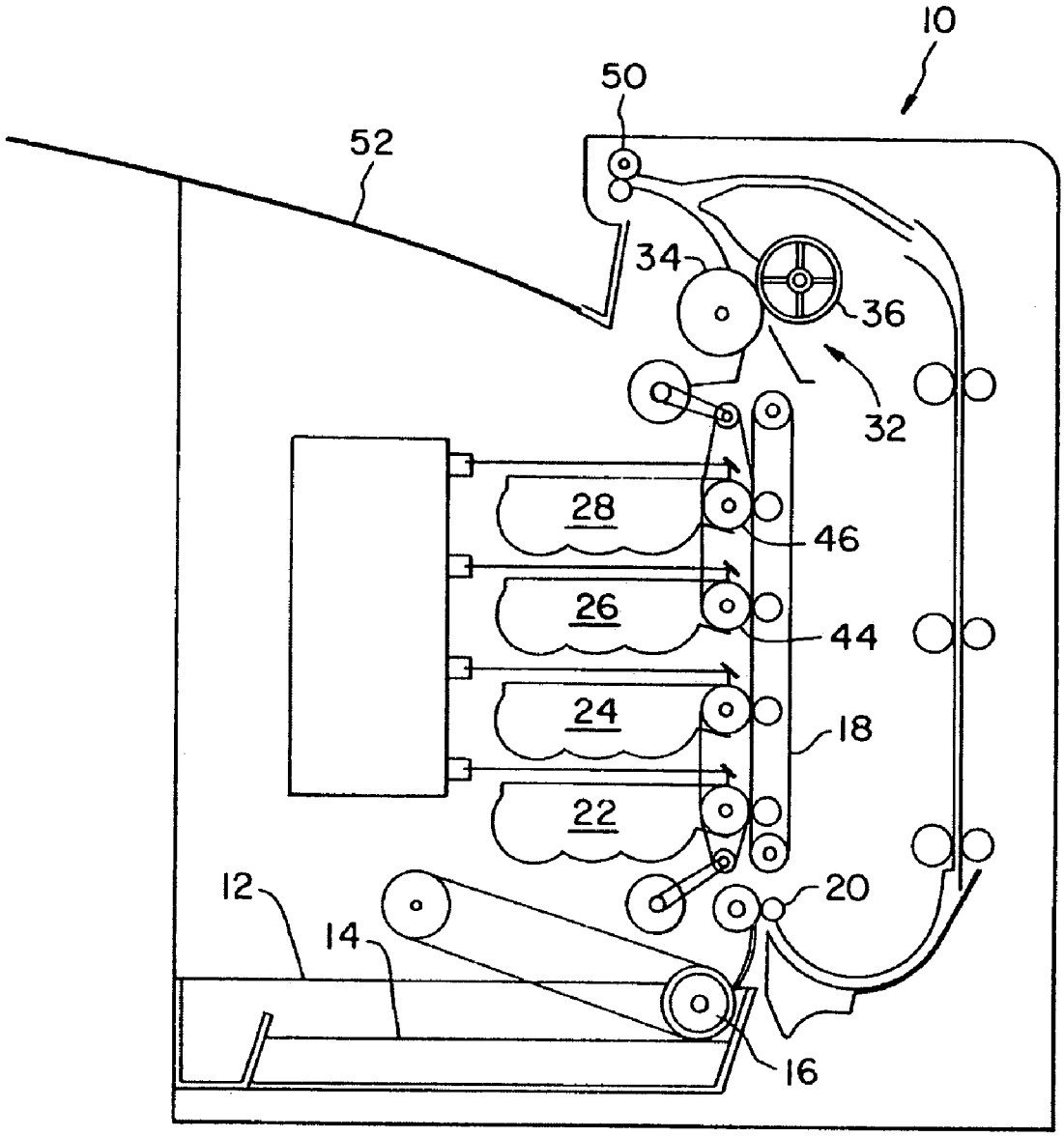
FIG. 1 is a simplified side, sectional view of an EP printer which may be used to carry out an embodiment of the method of the present invention.

Referring now to the drawings and particularly to FIG. 1, there is shown an embodiment of an EP printer 10 of the present invention. Paper supply tray 12 contains a plurality of print media, such as paper, transparencies or the like. A print medium transport assembly (not numbered) includes a plurality of rolls and/or transport belts for transporting individual print media 14 through EP printer 10. For example, in the embodiment shown, the print medium transport assembly includes a pick roll 16 and a paper transport belt 18. Pick roll 16 picks an individual print medium 14 from within paper supply tray 12 and transports print medium 14 to a bump-align nip defined in part by roll 20 to paper transport belt 18. Paper transport belt 18 transports the individual print medium past a plurality of color imaging stations 22, 24, 26 and 28 which apply toner particles of a given color to print medium 14 at selected pixel locations. In the embodiment shown, color imaging station 22 is a black (K) color imaging station; color imaging station 24 is a yellow (Y) color imaging station; color imaging station 26 is a magenta (M) color imaging station; and color imaging station 28 is a cyan (C) color imaging station.

Figure 2:
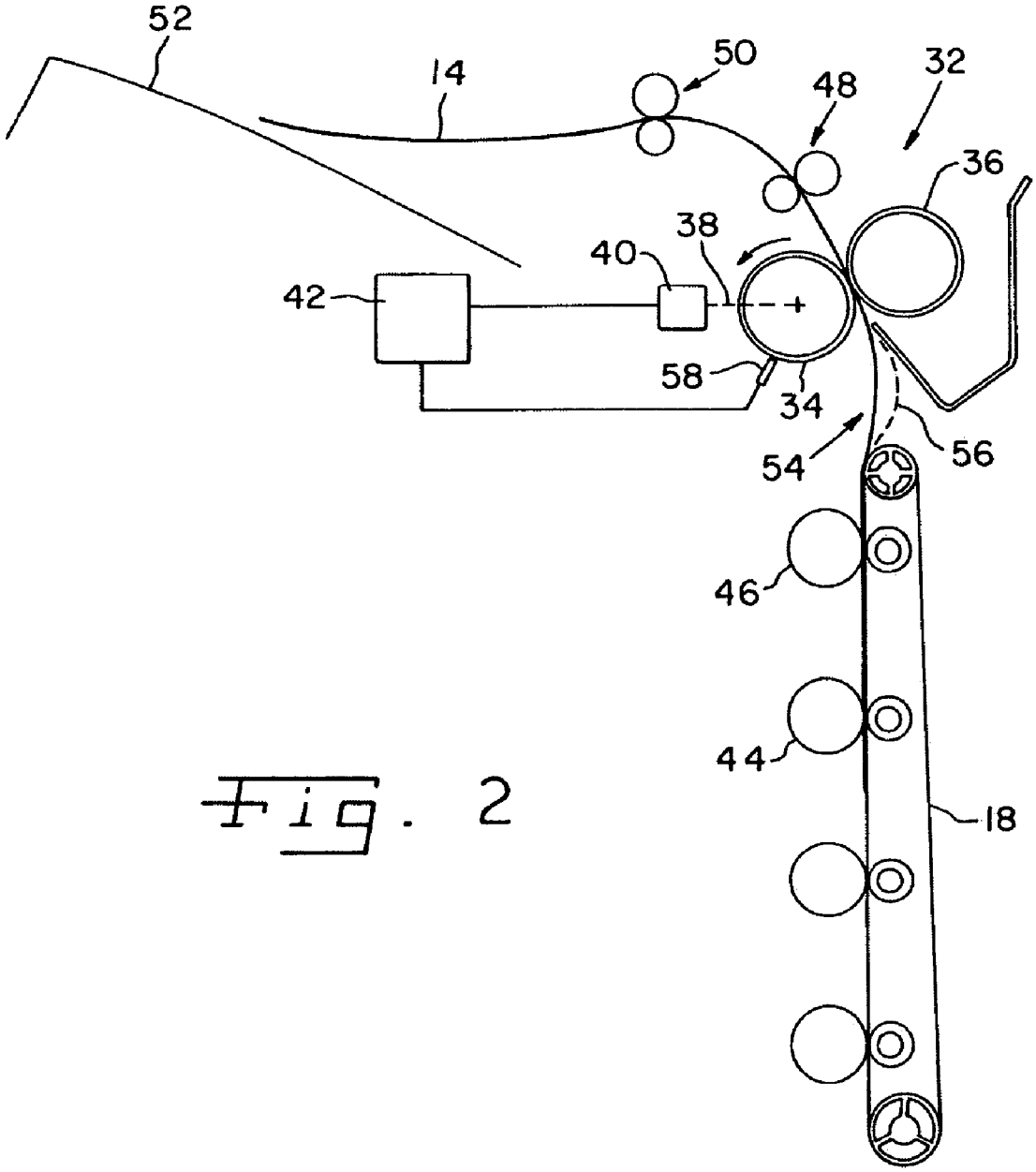
FIG. 2 is a schematic, side view of a portion of the paper transport assembly, fuser and electrical circuit of the EP printer shown in FIG. 1.

Paper transport belt 18 transports an individual print medium 14 (FIG. 2) to fuser 32 where the toner particles are fused to print medium 14 through the application of heat and pressure. Fuser 32 includes a hot fuser roll 34 and a back up roll 36. In the embodiment shown, fuser roll 34 is a driven roll and back-up roll 36 is an idler roll; however, the drive scheme may be reversed depending upon the application.

Techniques for the general concepts of heating fuser roll 34 and rotatably driving fuser roll 34 or back-up roll 36 using gears, belts, pulleys and the like (not shown) are conventional and not described in detail herein. Fuser roll 34 is schematically illustrated as being connected via phantom line 38 to drive motor 40, which is in turn connected to and controllably operated by electrical processing circuit 42, such as a microprocessor. Electrical processing circuit 42 is also coupled with temperature sensor 58 associated with hot fuser roll 34.

In the embodiment shown, print medium 14 is in the form of a legal length print medium. As is apparent, print medium 14 is concurrently present at the nips defined by a photoconductive (PC) drum 44 of color imaging station 26; a nip defined by PC drum 46 of color imaging station 28; a nip defined between fuser roll 34 and back-up roll 36; a nip defined by fuser exit rolls 48 and a nip defined by machine output rolls 50. The leading edge of print medium 14 is received within output tray 52 on the discharge side of machine output rolls 50.

PC drum 46 and the corresponding backup roll define an exit nip from the print medium transport assembly, and fuser rolls 34 and 36 define an entrance nip to fuser 32. As described above, it is undesirable to overdrive fuser roll 34 such that the fuser-controlled media velocity at the nip of fuser roll 34 exceeds the linear transport speed of paper transport belt 18. The force on media 14 from the nip between fuser roll 34 and back-up roll 36 typically is larger than the combination of the forces from the nips at PC drums 44 or 46 and the electrostatic force acting on the print medium, and thus the nip pressure and transport speed at fuser roll 34 tend to dominate the transport speed of the print medium conveyed on paper transport belt 18. If fuser roll 34 is overdriven such that the fuser-controlled media velocity is greater than that of paper transport belt 18, then print defects may occur on print medium 14. For this reason, fuser roll 34 may be under driven to cause a slight bubble 54 in the gap between the discharge side of paper transport belt 18 and the input side of the nip between fuser roll 34 and back-up roll 36. This bubble 54 may be more pronounced, as illustrated by phantom line 56 in FIG. 2. If the size of bubble 54 becomes too large because of the velocity differences between fuser roll 34 and paper transport belt 18, then print medium 14 may contact physical features within printer 10 resulting in print defects. That is fuser roll 34 should be under driven, but not to such an extent that defects resulting from scraping, etc. of print medium 14 occur.

In the embodiment shown, each of fuser roll 34 and back-up roll 36 have a PFA sleeve at the outside diameter over an elastomeric layer. The outside diameter of fuser roll 34 and back-up roll 36 is approximately 36mm at the outside diameter of the PFA sleeve when measured cold. It will be appreciated that the outside diameter of fuser roll 34 increases as the operating temperature of fuser roll 34 increases.

The method of the present invention accounts for manufacturing tolerances on fuser rolls which affect the speed of media 14 (such as paper 14) as it passes through fuser 32. This measurement operation allows the relative speed between fuser 32 and transport belt 18 to be set in the middle of an acceptable range, so that media 14 will build an optimal paper bubble 54 between the two systems. Otherwise, during some operating modes, fuser 32 pulls media 14 too tight and affects color registration, or it slows down too much during other modes and builds too large of a paper bubble 56, possibly causing tailflip and image smear. This method is carried out at the end of the printer manufacturing line, and is necessary if a fuser is replaced in the field.

More particularly, one method of determining a relative speed between fuser 32 and transport belt 18 is to monitor commanded voltage of motor 40 while sending pages through fuser 32 at different speeds. Such a method is more fully described in U.S. patent application Ser. No. 10/809,095, entitled "METHOD OF DETERMINING A RELATIVE SPEED BETWEEN INDEPENDENTLY DRIVEN MEMBERS IN AN IMAGE FORMING APPARATUS ", filed Mar. 25, 2004, which is also assigned to the assignee of the present invention.

According to an aspect of the present invention, another method of determining a relative speed between fuser 32 and transport belt 18 is to visually detect moiré patterns printed on multiple media 14 while sending pages through fuser 32 at different speeds.

Except when a sheet of media 14 is on both transport belt 18 and in the fuser nip between rolls 34 and 36, media 14 applies very little load to motor 40. Most of the fuser motor power is used to rotate fuser rolls 34 and 36 (which deform against one another as they rotate under load), fuser exit rolls 48 and machine output rolls 50. Even when a sheet 14 is on both transport belt 18 and in the fuser nip, if media 14 speed in fuser 32 is slower than the transport belt speed, a paper bubble 54 will develop, and little additional load will be imposed on motor 40. However, if a sheet is on both transport belt 18 and in the fuser nip, and media 14 speed in fuser 32 is faster than the independently driven transport belt speed, then fuser 32 will pull on media 14 and transport belt 18, raising the load on motor 40. During normal operation, this is not desirable since the load on transport belt 18 could lead to color registration errors. However, during a speed measurement sequence of the present invention, this additional load can be monitored by detecting changes in moiré patterns printed on media 14. The type of print artifact associated with the printed moiré patterns, depending upon the relative speeds of transport belt 18 and fuser 32, can be used to determine when the speeds are matched. With a known fuser speed which matches the transport belt speed, processor 42 adds an offset to slow fuser 32 so that a desired paper bubble is created, and the resulting sum is stored as a nominal fuser speed.

Moiré patterns are interference patterns made of slightly different images in different color planes. In one form, moiré patterns are an undesirable pattern that occurs when a halftone is made from a previously printed halftone. They are caused by the conflict between the dot arrangement produced by the halftone screen and the dots or lines of the original halftone. *McGraw-Hill Dictionary of Scientific and Technical Terms,* Fifth Edition, 1994. They can show subtle shifts in registration between the color planes from one location on media 14 to another. If media 14 speed through fuser 32 is faster than the current speed of paper transport belt 18, fuser 32 will pull on transport belt 18. This disturbance force will subtly affect the speed of media 14 on transport belt 18, either by encouraging slip between components or by allowing gear train windup between the transport belt motor and media 14 being printed. As a result, moiré patterns printed at different fuser speeds will show different registration effects caused by disturbance forces acting on transport belt 18. The highest fuser speed which doesn't introduce registration artifacts is assumed to be the fuser speed equal to the transport belt speed. For normal operation of fuser 32, a speed offset will be subtracted from this fuser speed so that a paper bubble 56 is formed between fuser 32 and transport belt 18.

Figure 3:
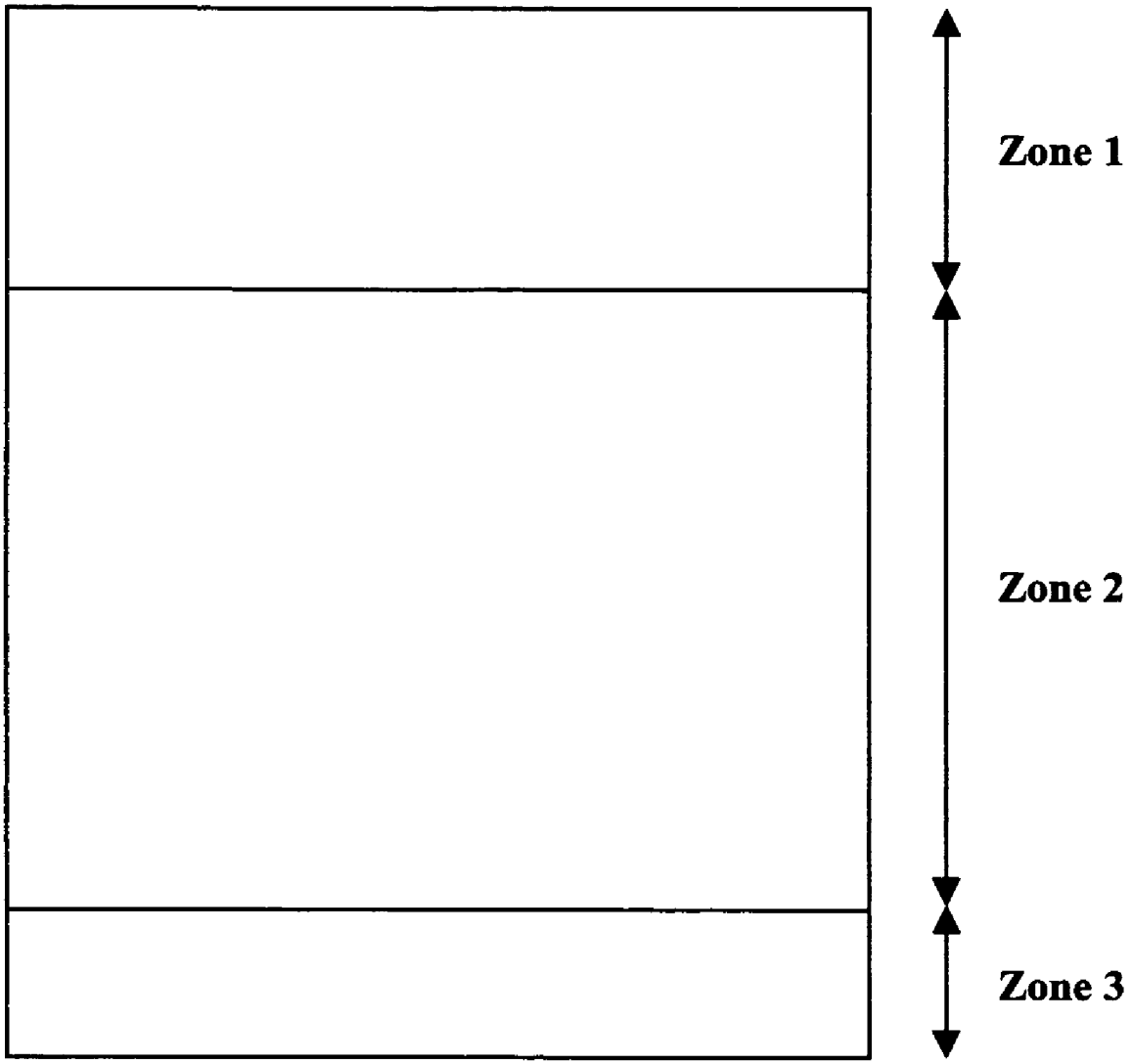
FIG. 3 is a graphical illustration of regions of interest for moiré patterns on a print sample.

FIG. 3 shows an example of different regions of print samples. FIG. 3 represents a letter-size media 14, and is oriented so that the top of the figure enters the electrophotographic process first. As media 14 enters the process, it progresses from a bump-align nip defined in part by roll 20 onto transport belt 18, where it is successively imaged by black, yellow, magenta, and cyan transfer stations, after which it enters fuser 32 and then exits from output rolls 50.

In zone 1, both the black and the cyan image planes are transferred to media 14 before the page enters fuser 32. Therefore, no forces from fuser 32 act on transport belt 18 during this time. In zone 2, the black image plane is transferred to media 14 before the page enters fuser 32, but the cyan image plane is transferred while the top of the page is in fuser 32. If fuser 32 is moving faster than transport belt 18, disturbance forces act on the belt while cyan is imaged in this zone, but not while black is imaged. Finally, in zone 3, both the black and cyan image planes are transferred to media 14 after the leading edge of the page enters fuser 32, so transport belt 18 is subject to disturbance forces from fuser 32 during this time. Table 1 shows the progress of a page through the printer, and the resulting distances down a page for imaging events.

TABLE 1

Paper Path and Imaging Positions on Page

| Page position in the process | Leading edge position (mm) | K image position (mm) | C image position (mm) |
|---|---|---|---|
| Leading edge at bump-align roll | 0 | | |
| Leading edge at K, page in bump-align | 64 | 0 | |
| Leading edge at C | 214 | 150 | 0 |
| Page in K, page still in bump-align | | | |
| Leading edge past C | 279.4 | 215.4 | 65.4 |
| Page in K, trailing-edge at bump-align | | | |
| Leading edge at fuser | 293 | 229 | 79 |
| Page in K and C | | | |
| Trailing edge at K | 343.4 | 279.4 | 129.4 |
| Page in C and fuser | | | |
| Page still in C, page still in fuser | | | |
| Trailing edge at C, page still in fuser | 493.4 | | 279.4 |

"Leading edge" is position of the leading edge of page, in mm along the paper path from the bump-align nip
"K image" is position on the page of the K image, in mm from the top of the page
"C image" is position on the page of the C image, in mm from the top of the page
Assumes letter-size paper (279.4 mm page length)
Note that A4 media is 297 mm long, and can be in both the bump-align system and fuser 32 at the same time.

Figure 4:
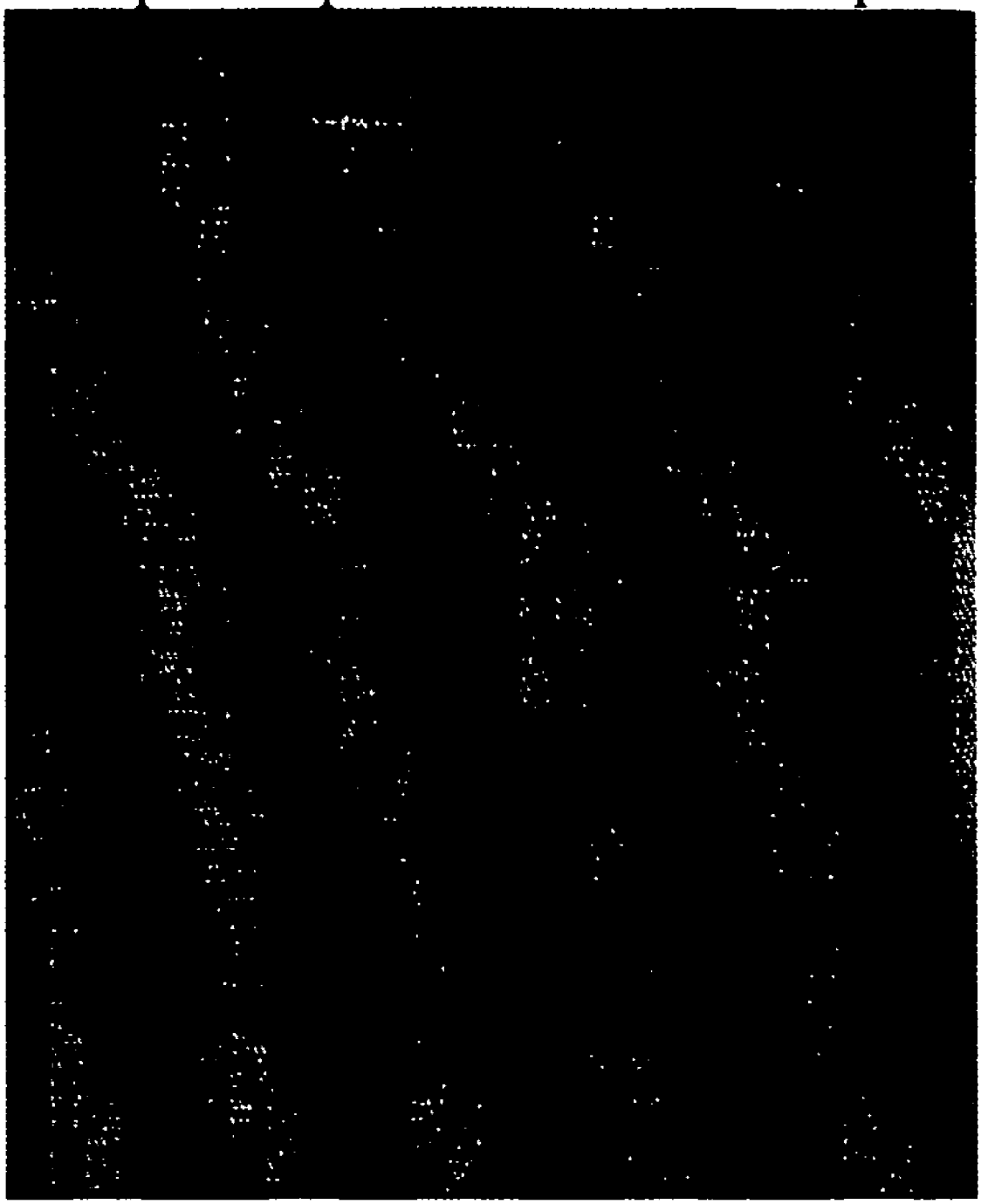
FIG. 4 is an example of a moiré print pattern made with a fuser speed of 104.991 mm/s.

FIG. 4 shows an example of a moiré print pattern made when the fuser speed is slower than the transport belt speed. Media forms a paper bubble between transport belt 18 and fuser 32 in this condition, so fuser 32 does not impart much of a disturbance force to transport belt 18 in this situation.

This moiré pattern was produced by combining a black halftone screen with a cyan halftone screen. The cyan screen is composed of closely-spaced horizontal lines, while the black screen is composed of closely-spaced lines which are tilted at a slight angle. Postscript (TM) functions were used to command a screen angle of 0.3 degrees for the black halftone screen, and 0.0 degrees for the cyan screen. Both screens are printed at 100 lines per inch, at a 33% intensity, in a 600 dpi mode. Since the angle of the black screen is so shallow compared to the print resolution, each black line is composed of horizontal regions connected by stairsteps between them. This means that black and cyan lines sometimes overlap and sometimes run parallel and adjacent to one another. The close spacing of the lines and their relatively wide widths mean that the apparent darkness of a region of the pattern is determined by whether the lines locally overlap or not. If the lines overlap, there will be some adjacent white space, resulting in a light area. If the lines don't overlap, they will completely fill the spaces between one another, resulting in a dark area. Because the stairsteps occur at regular intervals across the page, the regions of light and dark do as well, resulting in the pattern in FIG. 4.

If all of the printer components were "perfect," this moiré pattern would print as vertical bands running from the top to the bottom of media 14. However, component defects and speed variations during the imaging process cause shifts in media position and laser position which differ between the imaging of the black plane and the imaging of the cyan plane. Process-direction shifts show up in this moiré pattern as right-to-left motion of the vertical bands as they progress down media 14. For example, if fuser 32 pulls on transport belt 18 in zone 2 of the image, the vertical bands will veer off toward the right as they move down the page. Note that each one box step toward the right represents a process-direction registration shift of a single 600 dpi pixel.

Figure 5:
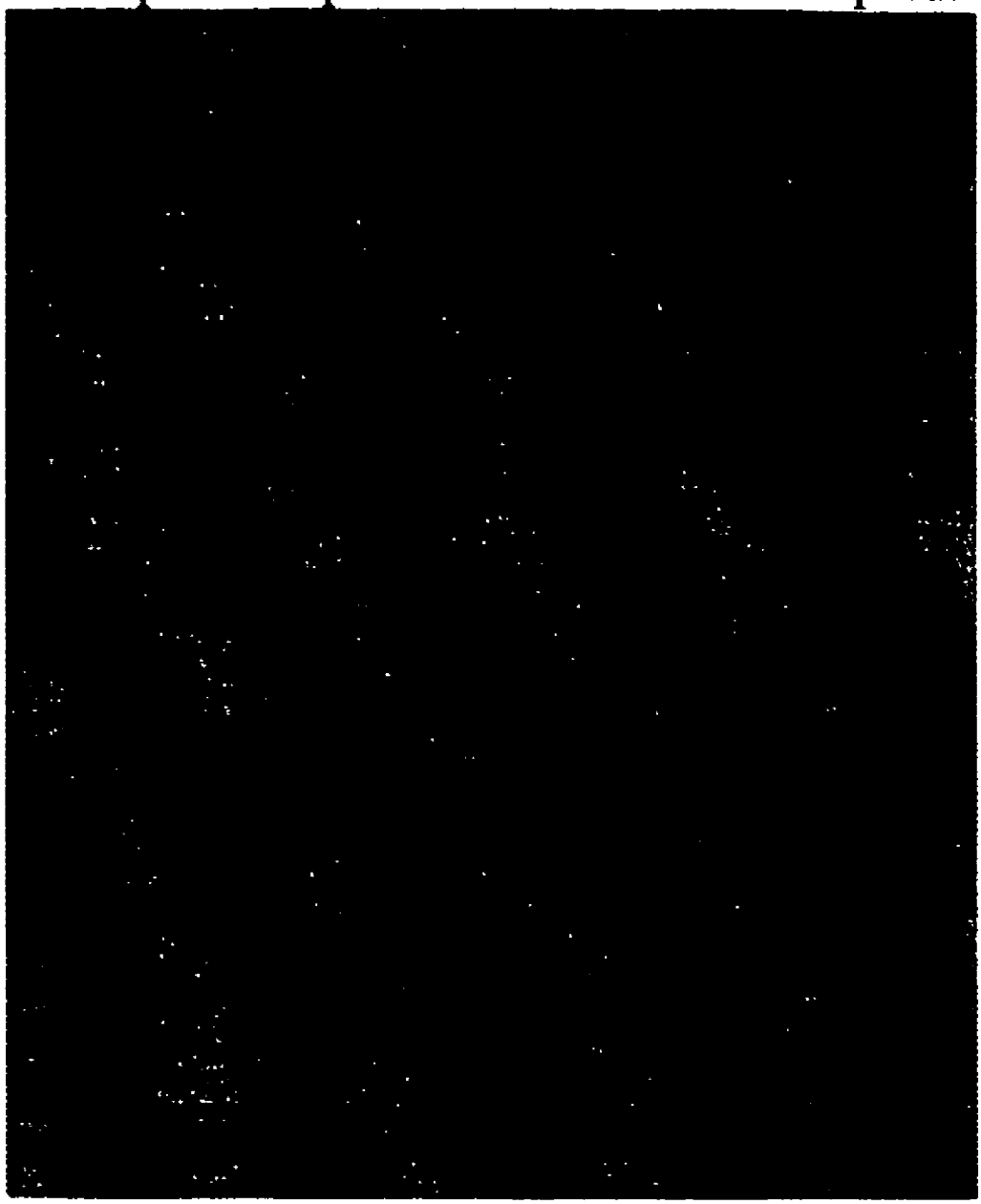
FIG. 5 is an example of a moiré print pattern made with a fuser speed of 107.030 mm/s.

FIG. 5 shows a moiré pattern made with a faster fuser speed of 107.030 mm/s, where fuser 32 does affect the speed of transport belt 18 in zone 2 this way.

Figure 6:
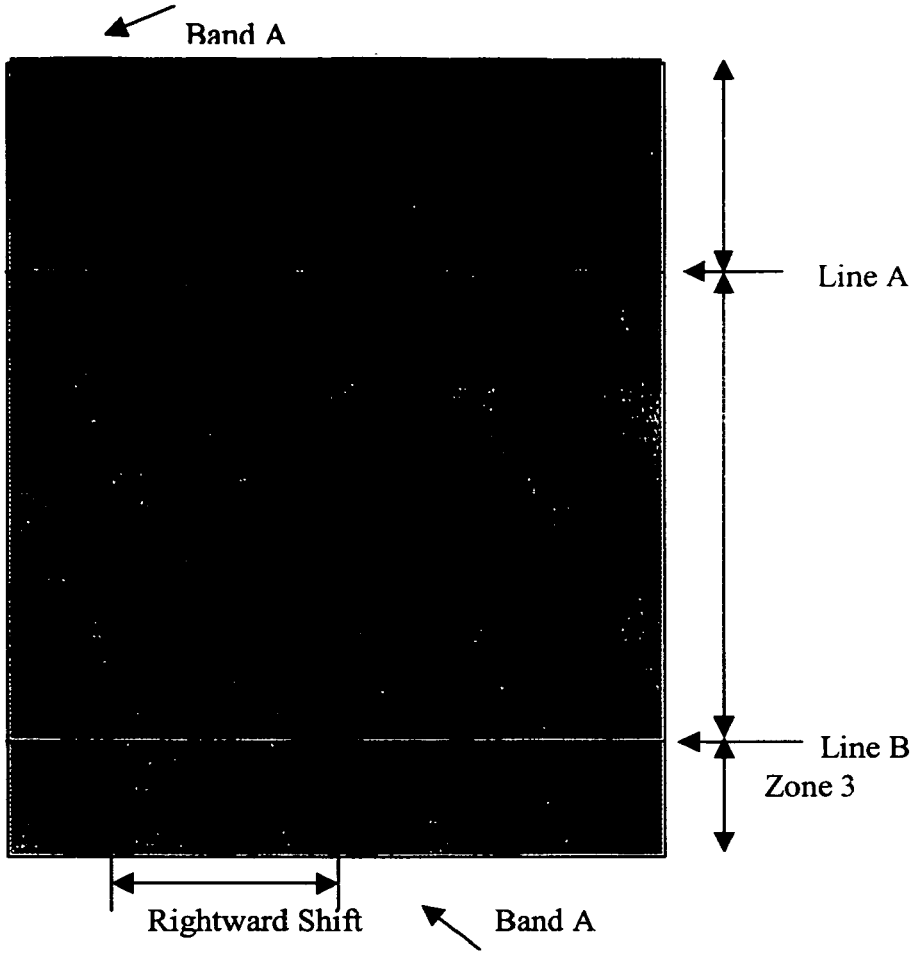
FIG. 6 illustrates how a moiré print pattern similar to that shown in FIG. 5 can be analyzed to determine an effect of the fuser speed on the transport belt.

FIG. 6 shows how this moiré pattern can be analyzed to determine the effect of fuser speed on transport belt 18 during the imaging process. The leftmost vertical band entirely present on the page is labeled "Band A," and the measurements are performed on this band. Since both color planes are imaged in zone 1 before media 14 enters fuser 32, and both color planes are imaged in zone 3 after media 14 enters fuser 32, neither of these zones can be used to assess fuser speed. However, black is imaged in zone 2 before media 14 enters fuser 32, and cyan is imaged in this zone after media 14 enters fuser 32. Therefore, if fuser 32 causes a transport belt speed increase when media enters fuser 32, this will show up as a rightward shift of a vertical band as it moves from Line A at the start of zone 2, down the page to Line B at the end of zone 2. Table 2 shows the positions of Line A and Line B on a printed page.

TABLE 2

Line positions for fuser speed measurement

| | |
|---|---|
| Line A: | 79 mm down from the top of the page [above this line, both black and cyan were imaged before media entered fuser] |
| Line B: | 229 mm down from the top of the page [below this line, both black and cyan were imaged after media entered fuser] |

Table 3 was generated by measuring a series of images at different fuser speeds. The rightward shifts in zone 2 of each sample made at a given speed were then averaged. Next, the rightward shift of the first, slow-fuser run was subtracted from each of the other runs, resulting in the column labeled "relative average."

TABLE 3

Speed measurement via moiré patterns

| Actual | Rightward shift of Moiré pattern between stations (mm) | | | | | | |
|---|---|---|---|---|---|---|---|
| Fuser Speed (mm/sec) | Sample #1 | Sample #2 | Sample #3 | Sample #4 | Sample #5 | Average of Samples | Relative Average |
| 104.991 | 53 | 39 | 44 | 38 | 32 | 41.2 | 0.0 |
| 106.647 | 76 | 92 | 64 | | | 77.3 | 36.1 |
| 107.030 | 69 | 104 | 76 | | | 83.0 | 41.8 |
| 107.540 | 165 | 131 | 166 | | | 154.0 | 112.8 |

Figure 7:
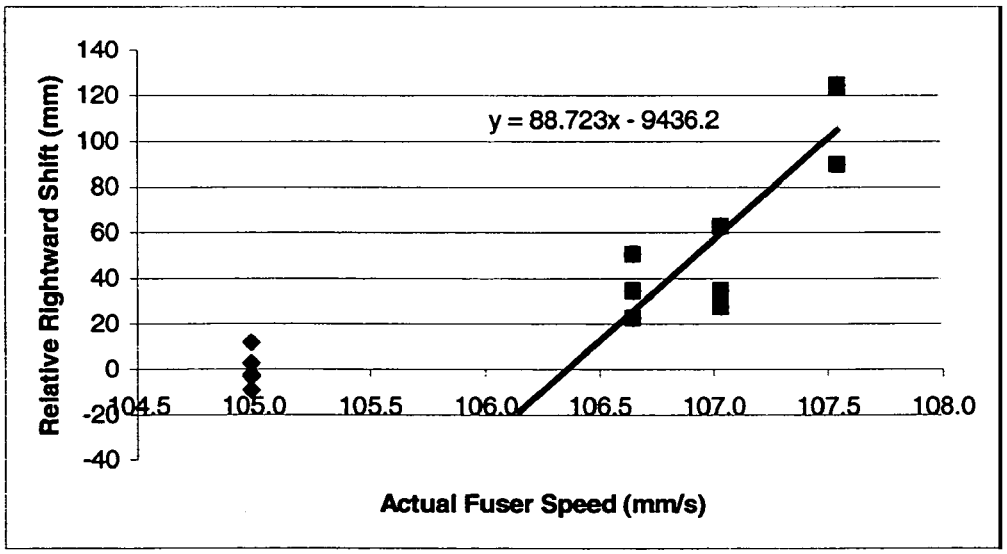
FIG. 7 is graphical illustration of a fuser speed estimate matching the transport belt speed based on moiré shift data.

Finally, a line was fit to the relative average shift data, estimating the lowest fuser speed which would not produce any more rightward shift than the very-slow-fuser setting. This data and the resulting line are plotted in FIG. 7. The intercept of the line is 106.36 mm/s, the estimated fuser speed to match the transport belt speed. With the fuser speed which most closely matches the speed of transport belt 18, the nominal fuser speed is set about 0.4 to 1.8% slower than this speed, preferably 1.05% slower, to put the nominal size of paper bubble 56 in the middle of the range of its possible sizes.

The previous scheme for determining relative speeds between fuser 32 and transport belt 18 has been tested and does work. An improved scheme which could perform the whole process on a single page is also possible. For example, instead of printing each entire page at a constant fuser speed, the fuser speed can begin fast and progressively slow during Zone 2 on a single page. This changing speed produces moiré bands with changing slopes in Zone 2, rather than the relatively constant-slope lines produced by the method described above. Fuser 32 and transport belt have the same speed when the slope becomes vertical in Zone 2, because fuser 32 is no longer pulling on transport belt 18 at this point. Instead of measuring rightward shifts on each page, the important value is the distance up from Line B to where the slope of the bands becomes vertical. This distance is used to interpolate the fuser speed at that point in the imaging process, and this speed is assumed to match the speed of transport belt 18. While this require fewer measurements, it also requires nearly perfect machine registration for accurate measurement. Also, it requires fuser 32 to run very fast at the beginning of the sequence to prevent the creation of a bubble 56 which would uncouple fuser speed from registration shifts at known positions on a page. This high-speed operation risks over-current errors which might interrupt the process and prevent successful speed measurement.

Another aspect of the invention determines a known fuser speed which matches the transport belt speed and then uses this information to build and maintain a bubble between the two elements. During normal printing in this mode, the fuser is set to run slower than the matched speed at the start of each sheet of media until a small bubble develops. Then, the fuser is accelerated to the matched speed and runs at that speed for the remainder of the sheet, in order to maintain the bubble at a consistent size.

These methods could also be automated by measuring the moiré patterns in a printer. A sensor placed at the exit from the transport belt could measure the reflectivity differences caused by the light and dark zones of the moiré pattern and relative speeds could be determined this way.

Further, the method of the present invention as described above for determining a relative speed between two separately and independently driven members in an image forming apparatus may be used with independently driven members other than a fuser and a paper transport assembly. For example, a print medium may be transported from an exit nip of an upstream and independently driven bump-align motor to the entry nip of a transport belt. The present invention allows the relative speed between the transport speed at the exit nip of the upstream bump-align motor and the entry nip of a transport belt to be determined, and an adjustment made to one or both transport speeds, if necessary.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of determining a relative speed between two separately driven members in an image forming apparatus, comprising the steps of:

transporting a print medium using a print media transport assembly including a first nip, said print media transport assembly operable at a first transport speed;

driving a rotatable member associated with a second nip at a second transport speed which is independent from said first transport speed;

printing a first image on the print medium when the print medium is in at least one of said first nip and said second nip;

printing a second image on the print medium when the print medium is in each of said first nip and said second nip, said second image overlapping said first image;

detecting a moiré pattern caused by said first image and said second image; and determining a speed relationship between said first transport speed and said second transport speed, dependent upon said detected moiré pattern.

2. The method of claim 1, including the steps of:

transporting an other print medium using said print media transport assembly at said first transport speed;

driving said rotatable member at a third transport speed which is different from said second transport speed;

repeating said first printing step, said second printing step and said detecting step using said third transport speed; and determining whether at least one of said second transport speed and said third transport speed of said rotatable member is faster than said first transport speed of said print media transport assembly.

3. The method of claim 2, including the steps of:

determining a matched transport speed of said rotatable member which is closest to said first transport speed; and subtracting a speed offset from the matched transport speed of said rotatable member which is closest to said first transport speed.

4. The method of claim 3, wherein said speed offset is between approximately 0.4 to 1.8% of said matched transport speed.

5. The method of claim 4, wherein said speed offset is approximately 1.05% of said matched transport speed.

6. The method of claim 1, further including the step of calculating a numerical analysis data fit using said detected moiré patterns.

7. The method of claim 6, wherein said data fit is a linear data fit.

8. The method of claim 1, wherein said moiré pattern is represented by a diagonal print artifact.

9. The method of claim 8, wherein said diagonal print artifact has a slope dependent upon a speed difference between said first transport speed and said second transport speed.

10. The method of claim 1, wherein said moiré pattern is represented by a print artifact extending in an advance direction of the print medium when said second transport speed is not greater than said first transport speed.

11. The method of claim 1, wherein said first image is printed in a first color and said second image is printed in a second color.

12. The method of claim 11, wherein said first image is printed using black toner particles and said second image is printed using color toner particles.

13. The method of claim 12, wherein said second image is printed using cyan toner particles.

14. The method of claim 1, wherein said first printing step and said second printing step occur at said print media transport assembly.

15. The method of claim 1, wherein said rotatable member comprises one of a fuser roll and a bump-align roll.

16. The method of claim 1, including the steps of:

determining a matched transport speed of said rotatable member which is closest to said first transport speed;

subtracting a speed offset from the matched transport speed of said rotatable member which is closest to said first transport speed;

printing on a first portion of an other print medium using said speed offset from said matched transport speed; and printing on a second portion of the other print medium using said matched transport speed.

17. The method of claim 16, wherein said step of printing on the other print medium using said speed offset is carried out so as to build a bubble in the other print medium prior to said second nip.

18. A method of operating an image forming apparatus, comprising the steps of:

transporting a first print medium, comprising the substeps of:

transporting the first print medium using a print media transport assembly including a first nip, said print media transport assembly operable at a first transport speed;

driving a rotatable member associated with a second nip at a second transport speed which is independent from said first transport speed;

printing a first image on the first print medium when the first print medium is in at least one of said first nip and said second nip;

printing a second image on the first print medium when the first print medium is in each of said first nip and said second nip, said second image overlapping said first image; and detecting a moiré pattern caused by said first image and said second image; and transporting a second print medium, comprising the substeps of:

transporting the second print medium using said print media transport assembly at said first transport speed;

driving said rotatable member at a third transport speed which is different from said second transport speed; and repeating said first printing step, said second printing step and said detecting step on the second print medium using said third transport speed; and determining whether at least one of said second transport speed and said third transport speed of said rotatable member is faster than said first transport speed of said print media transport assembly.

* * * * *